US006033275A

United States Patent [19]

Ely

[11] Patent Number: 6,033,275

[45] Date of Patent: Mar. 7, 2000

[54] WATER SAFETY FLOATATION ASSEMBLY AND ASSOCIATED METHOD

[76] Inventor: Christina L. Ely, 604 Shafor Blvd., Dayton, Ohio 45419

[21] Appl. No.: 09/186,448

[22] Filed: Nov. 5, 1998

[51] Int. Cl.[7] ..... B63C 9/08

[52] U.S. Cl. ..... 441/89; 116/173

[58] Field of Search ..... 441/108, 113, 441/89, 88; 116/173

[56] References Cited

U.S. PATENT DOCUMENTS

| | | | |
|---|---|---|---|
| 3,213,823 | 10/1965 | Levy et al. | 116/114 |
| 4,035,856 | 7/1977 | Oberg | 9/313 |
| 4,523,914 | 6/1985 | Faulconer et al. | 441/108 |
| 4,598,661 | 7/1986 | Roe | 116/209 |
| 4,752,264 | 6/1988 | Melendez et al. | 441/89 |
| 5,114,369 | 5/1992 | Coffey | 411/11 |
| 5,423,282 | 6/1995 | Krull et al. | 116/209 |
| 5,651,711 | 7/1997 | Samano | 441/89 |
| 5,671,480 | 9/1997 | Krout et al. | 2/102 |
| 5,893,786 | 4/1999 | Stevens | 441/89 |

*Primary Examiner*—Stephen Avila
*Attorney, Agent, or Firm*—Maginot, Addison & Moore

[57] ABSTRACT

A water safety floatation assembly includes a water safety vest and a pocket secured to the water safety vest. The assembly further includes a flag and pole assembly positionable between a stowed position and a signaling position, wherein (i) the flag and pole assembly is located within the pocket when the flag and pole assembly is positioned in the stowed position, and (ii) the flag and pole assembly is removed from the pocket and completely spaced apart from the flotation member when the flag and pole assembly is positioned in the signaling position. A method of using a signaling device during performance of a water sport activity is also disclosed.

17 Claims, 1 Drawing Sheet

WATER SAFETY FLOATATION ASSEMBLY AND ASSOCIATED METHOD

BACKGROUND OF THE INVENTION

The present invention relates generally to a water safety floatation assembly. The present invention further relates to a method of using a signaling device during performance of a water sport activity.

It is imperative that the participants of water sports, such as water tubing, water skiing, jet skiing, and sailing, wear safety flotation devices designed to support a person while in the water. For example, in the case of water tubing, frequently the tuber will lose his or her balance or suffer some other mishap which results in the tuber falling into the water. However, if the tuber is wearing a safety flotation device, such as a flotation vest, he or she will be supported in the water such that the likelihood of drowning is reduced.

However, because water sports (such as water tubing) is frequently undertaken in water ways used by many power boats or other water craft, including high speed power boats, a water sport participant (such as a water tuber) who has fallen in the water is subject to hazards other than drowning which arise during the time they spend floating in the water. For example, while a water tuber is highly visible while traveling across the water surface, he or she is very difficult to see after he or she falls into the water. Note that after the water tuber falls into the water, the water tuber would be left in the water without any signaling device except for his or her hands and arms. As a result, a water tuber floating in the water is subject to substantial risk of being struck by speeding power boats which can cause serious injury or even death. This is especially true with children since they are even harder to see floating in the water due to their small size.

In an attempt to address the aforementioned problem, various water sport participant safety apparatus have been designed. A number of these apparatus include a signaling device for indicating the location of the water sport participant. However, these safety apparatus do not allow a water sport participant to enhance the visibility of the signaling device under certain desirable circumstances. In particular, the signaling device cannot be easily waved back and forth by a water sport participant when a speed boat is traveling directly toward the water sport participant at a relatively high rate of speed. Also some of these apparatus are mechanically complex and difficult to manufacture.

The present invention is directed to overcoming one or more of the problems set forth above.

SUMMARY OF THE INVENTION

In accordance with a first embodiment of the present invention, there is provided a water safety floatation assembly. The assembly includes a water safety vest and a pocket secured to the water safety vest. The assembly further includes a flag and pole assembly positionable between a stowed position and a signaling position, wherein (i) the flag and pole assembly is located within the pocket when the flag and pole assembly is positioned in the stowed position, and (ii) the flag and pole assembly is removed from the pocket and completely spaced apart from the flotation member when the flag and pole assembly is positioned in the signaling position.

In accordance with a second embodiment of the present invention, there is provided a water safety floatation assembly. The assembly includes a flotation member and a pocket secured to the floatation member. The assembly further includes a signaling device positionable between a stowed position and a signaling position, wherein (i) the signaling device is located within the pocket when the signaling device is positioned in the stowed position, and (ii) the signaling device is removed from the pocket and completely spaced apart from the flotation member when the signaling device is positioned in the signaling position.

In accordance with a third embodiment of the present invention, there is provided a method of using a signaling device during performance of a water sport activity. The method includes the steps of (i) attaching a floatation member to a water sport participant, the floatation member having a pocket secured thereto, (ii) performing the water sport activity by the water sport participant after the attaching step, (iii) stowing the signaling device in the pocket of the floatation member during the water sports activity performing step, and (iv) removing the signaling device from the pocket of the floatation member during the water sports activity performing step so that the signaling device is completely spaced apart from the flotation member.

One object of the present invention is to provide a new and water safety floatation assembly.

Another object of the present invention is to provide an improved water safety floatation assembly.

Still another object of the present invention is to provide a new and useful method of using a signaling device during the performance of a water sports activity such as water tubing.

Yet another object of the present invention is to provide an improved method of using a signaling device during the performance of a water sports activity such as water tubing.

Another object of the present invention is to provide a water safety floatation assembly which allows a water sport participant to enhance the visibility of the signaling device.

Still another object of the present invention is to provide a water safety floatation assembly which is relatively less mechanically complex.

Moreover another object of the present invention is to provide a water safety floatation assembly which is relatively easy to manufacture.

Other objects and benefits of the present invention can be discerned from the following description and accompanying drawings.

DETAILED DESCRIPTION OF THE INVENTION

Figure 1:
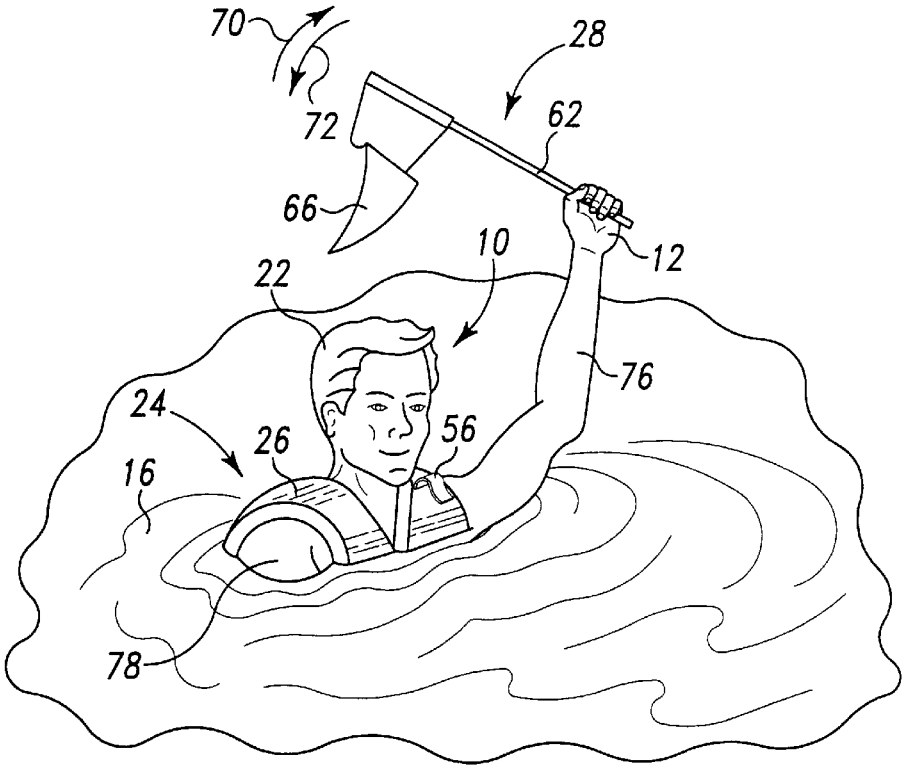
FIG. 1 is a perspective view of a water sport participant floating in the water while utilizing a water safety floatation assembly which incorporates the features of the present invention therein (note that, in FIG. 1, the signaling device of the water safety floatation assembly is located in the signaling position)

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
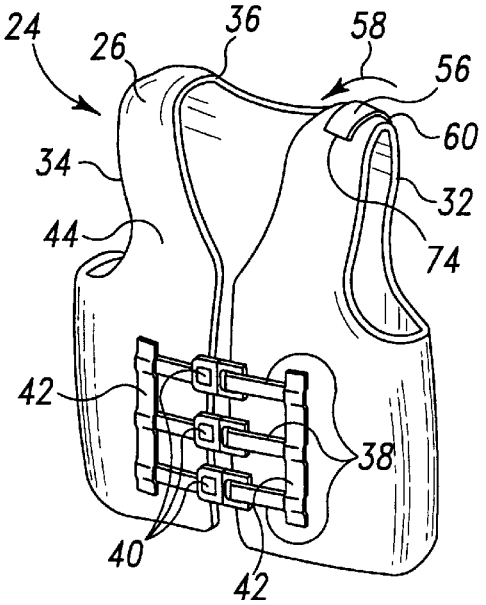
FIG. 2 is a perspective view of a front side of the water safety floatation assembly shown in FIG. 1.
Figure 3:
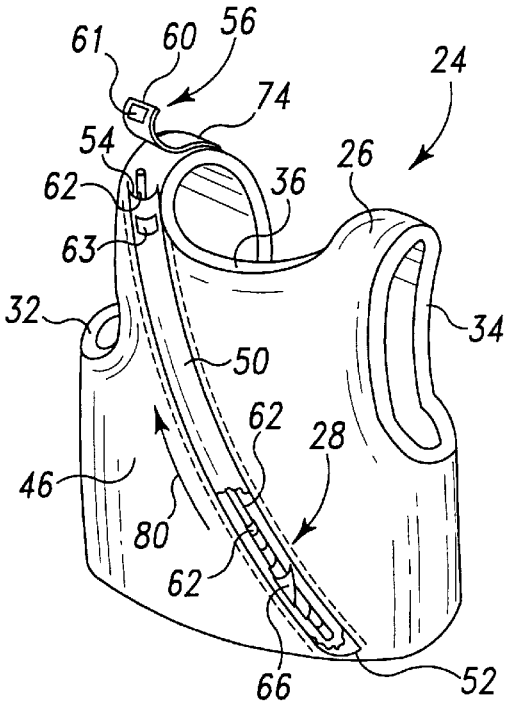
FIG. 3 is a perspective view of a rear side of the water safety floatation assembly shown in FIG. 1, with the signaling device of the water safety floatation assembly located in the stowed position.

Referring now to FIGS. 1–3, there is shown a water safety apparatus 24 for use by a water sport participant 10 (e.g. a water tuber) which incorporates the features of the present invention therein. Safety apparatus 24 includes a flotation member 26 and a signaling device 28.

Flotation member 26 includes is configured as a water safety vest and has numerous advantages of the present invention by having such a configuration. However, the floatation member 26 may alternatively possess other configurations such as a belt while still possessing many of the advantages of the present invention.

Floatation member has a front side 44 and a back side 46. Flotation member 26 also has a left aperture 32, a right aperture 34, and a center aperture 36 defined therein. In addition, floatation member 26 includes a number of belts 38 attached thereto by a pair of straps 42. Each belt 38 has a buckle 40 attached thereto as shown in FIG. 2. Floatation member 26 has a pocket 50 secured to the back side 46 of the flotation member 26. Pocket 50 has a closed end 52 and an open end 54. Pocket 50 includes a rectangular segment of cloth material which is attached to the floatation member 26. The rectangular segment of cloth in conjunction with the outer surface of the floatation member 26 forms a compartment which is adapted to stow the signaling device 28 therein. Alternatively, pocket 50 may include two segments of material which are sewn together to form a compartment therebetween, and the two segments of material may be secured to the outer surface of the floatation member 26. Thus, it should be appreciated that the pocket 50 may be any object or multiple objects which could be attached to the floatation member 26 and possess or form a compartment when attached.

A flap 56 having an end 60 and an end 74 is secured to floatation member 26 at end 74. The end 60 of flap 56 has a first attachment member 61 secured thereto. A second attachment 63 is secured to the pocket 50 as shown in FIG. 3. The first attachment member 61 includes a first hook-loop fastener segment, while the second attachment member 63 includes a second hook-loop fastener segment. The first loop-hook fastener segment includes a plurality of upstanding loop-type engagement elements. The second loop-hook fastener segment includes a plurality of upstanding hook-type engagement elements. One first loop-hook fastener segment and one second loop-hook fastener segment which may be used in the present invention are disclosed in U.S. Pat. No. 4,149,540 issued to Hasslinger, the disclosure of which is herein incorporated by reference.

Flap 56 is secured to floatation member 26 such that flap 56 is positionable between an open position (see FIG. 3) and a closed position (a position where first attachment member 61 is positioned in contact with second attachment member 63). It should be understood that (i) when flap 56 is located in the closed position, flap 56 is disposed over open end 54 of pocket 50, and (ii) when flap 56 is located in the open position flap 56 is spaced apart from open end 54 of pocket 50.

Signaling device 28 includes a pole 62 and a flag 66. Flag 66 is secured to pole 62 as shown in FIG. 1. Signaling device 28 is positionable between a stowed position as shown in FIG. 3 and a signaling position as shown in FIG. 1.

It should be understood that signaling device 28 is located within pocket 50 of floatation member 26 when signaling device 28 is positioned in the stowed position. Specifically, when signaling device 28 is positioned in the stowed position flag 66 is wrapped around pole 62 as shown in FIG. 3, and pole 62 is inserted through open end 54 of pocket 50 until and end thereof is located adjacent to closed end 52 of pocket 50 and another end thereof is located adjacent to open end 54 of pocket 50 as shown in FIG. 3.

It should also be understood that signaling device 28 is removed from pocket 50 and completely spaced apart from floatation member 26 when signaling device 28 is positioned in the signaling position. For example, as shown in FIG. 1, signaling device 28 has been removed from pocket 50 and is completely spaced apart from floatation member 26 by grasping pole 62 with the left hand 12 of the water sport participant 10.

During use of water safety floatation assembly 24, water sport participant 10 unbuckles each buckle 40 and inserts his (or her) left arm 76 through left aperture 32 and his (or her) right arm 78 through right aperture 34 such that head 22 of water sport participant 10 extends above center aperture 36 as shown in FIG. 1. Water sport participant 10 then couples each buckle 40 such that floatation member 26 is secured around the torso of water sport participant 10. It should be appreciated that unless water sport participant 10 wants to indicate his (or her) location to an observer (e.g. a boat driver—not shown), signaling device 28 remains in the stowed position and flap 56 is located in the closed position so as to prevent removal of signaling device 28 from pocket 50 of floatation member 26.

However, if water sport participant 10 wants to indicate his or her position to an observer, signaling device 28 is then moved to the signaling position. For example, when water sport participant 10 is floating in a body of water 16 (see FIG. 1) and wants to indicate his (or her) position to an observer, water sport participant 10 grasps end 60 of flap 56 with either left hand 12 or right hand 14 and moves flap 56 in a direction indicated by arrow 58 (see FIG. 2). Moving flap 56 in the direction indicated by arrow 58 locates flap 56 in the open position (see FIG. 3) thereby exposing open end 54 of pocket 50 such that signaling device 28 can be removed from pocket 50. Water sport participant 10 then grasps pole 62 with either left hand 12 or right hand 14 and pulls signaling device 28 out of pocket 50 in a direction indicated by arrow 80 (see FIG. 3). Water sport participant 10 continues to pull signaling device 28 out of pocket 50 until signaling device is completely separated or spaced apart from floatation member 26 as shown in FIG. 1. Once signaling device 28 is completely separated from floatation member 26, water sport participant 10 can hold flag 66 above his head 22 and wave flag 66 in the directions indicated by arrows 70 and 72.

Note that when water sport participant 10 is floating in a body of water 16, the lower portion of the water sport participant 10 is located below a surface of the body of water 16 as shown in FIG. 1. This makes the water sport participant 10 difficult to see by other boat drivers when the water sport participant is floating in the body of water 16. This problem is exacerbated when the water sports participant is a child since children are generally much smaller than adults.

Being able to completely separate or space signaling device 28 apart from floatation member 26 is an important aspect of the present invention since it allows water sport participant 10 to enhance the visibility of signaling device 28. More specifically, completely separating or spacing signaling device 28 apart from floatation member 26 allows water sport participant to vigorously wave flag 66 in the above described manner thereby enhancing the visibility of flag 66 and greatly facilitating the ability of an observer to locate the position of water sport participant 10.

It should be appreciated that, under certain circumstances, enhancing the visibility of flag 66 is extremely important. For example, if a high speed power boat (not shown) is traveling toward water sport participant 10, water sport participant 10 can quickly locate signaling device 28 in the signaling position and vigorously wave flag 66 in the above described manner in order to enhance the visibility of signaling device 28 thereby increasing the likelihood that the driver of the high speed power boat will see signaling device 28 and avoid colliding with water sport participant 10. Once water sport participant 10 has finished using signaling device 28 in the above described manner, signaling device 28 is located in the stowed position (see FIG. 3) and flap 56 is located in the closed position such that water sport participant 10 can continue with his (or her) activities if desired.

The above described use of the water safety floatation assembly 24 is distinguishable from the use of other safety floatation apparatus designs which do not allow their respective signaling devices to be completely separated or spaced apart from the flotation member. Not being able to completely separate the signaling device from the flotation member severely limits the ability of the water sport participant to manipulate or otherwise wave the signaling device in the above described manner. As a result, these safety apparatus do not allow the water sport participant to enhance the visibility of the signaling device under the above-described circumstances (i.e. when a speeding power boat is traveling toward the water sport participant).

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

What is claimed is:

1. A water safety floatation assembly, comprising:

a water safety vest having a front facing side and a rear facing side, wherein (i) when said water safety vest is worn by a user, a chest of said user is positioned adjacent to said front facing side and a back of said user is positioned adjacent to said rear facing side, (ii) said rear facing side of said water safety vest defines a first rear lateral side and a second rear lateral side, (iii) said rear facing side of said water safety vest further defines an upper rear edge portion and a lower rear edge portion, and (iv) a first rear lateral upper corner area is defined by the intersection of said first rear lateral side and said upper rear edge portion, and a second rear lateral lower corner area is defined by the intersection of said second rear lateral side and said lower rear edge portion;

a pocket secured to said rear facing side of said water safety vest, said pocket extending continuously in a diagonal manner across said rear facing side of said water safety vest from said first rear lateral upper corner area to said second rear lateral lower corner area; and a flag and pole assembly positionable between a stowed position and a signaling position, wherein (i) said flag and pole assembly is located within said pocket when said flag and pole assembly is positioned in said stowed position, and (ii) said flag and pole assembly is removed from said pocket and completely spaced apart from said flotation member when said flag and pole assembly is positioned in said signaling position.

2. The assembly of claim 1, further comprising a flap having a first end and a second end, wherein:

said first end of said flap is secured to said water safety vest, said second end of said flap has a first attachment member secured thereto, said pocket has a second attachment member secured thereto, and said second attachment member is adapted to cooperate with said first attachment member so as to secure said second end of said flap to said pocket.

3. The assembly of claim 2, wherein:

said first attachment member includes a first loop-hook fastener segment, and said second attachment member includes a second loop-hook fastener segment.

4. The assembly of claim 2, wherein:

said flap is positionable between an open position and a closed position, wherein (i) said flap is disposed over an open end of said pocket so as to prevent removal of said flag and pole assembly from said pocket when said flap is located in said closed position, and (ii) said flap is spaced apart from said open end of said pocket so as to allow removal of said flag and pole assembly from said pocket when said flap is located in said open position.

5. The water safety floatation assembly of claim 1, wherein:

said pocket possesses an open end located at said first rear lateral upper corner area, and said pocket possesses a closed end located at said second rear lateral lower corner area.

6. The water safety floatation assembly of claim 5, wherein:

said signaling device includes (i) a pole, and (ii) a flag attached to said pole, and a first end of said pole is positioned adjacent to said open end of said pocket and a second end of said pole is positioned adjacent to said closed end of said pocket when said signaling device is positioned within said pocket.

7. The water safety floatation assembly of claim 1, wherein:

said rear facing side of said water safety vest defines a first compartment surface, said pocket includes a segment of material which defines a second compartment surface, and said flag and pole assembly is interposed between said first compartment surface and said second compartment surface when said flag and pole assembly is positioned in said stowed position.

8. The water safety floatation assembly of claim 7, wherein:

said segment of material is a segment of cloth material, and said segment of cloth material is attached to said rear facing side of said floatation member so as to form a compartment.

9. A water safety floatation assembly, comprising:

a flotation member having a front facing side and a rear facing side, said rear facing side of said floatation member defines a first rear lateral side portion and a second rear lateral side portion;

a pocket secured to said rear facing side of said floatation member, said pocket extending continuously across said rear facing side of said floatation member from said first rear lateral side portion to said second rear lateral side portion; and a signaling device positionable between a stowed position and a signaling position, wherein (i) said signaling device is located within said pocket when said signaling device is positioned in said stowed position, and (ii) said signaling device is removed from said pocket and completely spaced apart from said flotation member when said signaling device is positioned in said signaling position, wherein said signaling device includes (i) a pole, and (ii) a flag attached to said pole, and wherein a first end of said pole is positioned at said first rear lateral side portion and a second end of said pole is positioned at said second rear lateral side portion when said signaling device is located within said pocket.

10. The assembly of claim 9, further comprising a flap having a first end and a second end, wherein:

said first end of said flap is secured to said floatation member, said second end of said flap has a first attachment member secured thereto, said pocket has a second attachment member secured thereto, and said second attachment member is adapted to cooperate with said first attachment member so as to secure said second end of said flap to said pocket.

11. The assembly of claim 10, wherein:

said first attachment member includes a first loop-hook fastener segment, and said second attachment member includes a second loop-hook fastener segment.

12. The assembly of claim 10, wherein:

said flap is positionable between an open position and a closed position, wherein (i) said flap is disposed over an open end of said pocket so as to prevent removal of said signaling device from said pocket when said flap is located in said closed position, and (ii) said flap is spaced apart from said open end of said pocket so as to allow removal of said signaling device from said pocket when said flap is located in said open position.

13. The assembly of claim 9, wherein said pole and said flag are each positioned in said pocket when said signaling device is positioned in said stowed position.

14. The assembly of claim 9, wherein said floatation member includes a water safety vest having said pocket secured thereto.

15. The water safety floatation assembly of claim 9, wherein:

said pocket possesses an open end located at said first rear lateral side portion, and said pocket further possesses a closed end located at said second rear lateral side portion.

16. The water safety floatation assembly of claim 13, wherein:

said rear facing side of said floatation member defines a first compartment surface;

said pocket includes a segment of material which defines a second compartment surface, and said flag and pole assembly is interposed between said first compartment surface and said second compartment surface when said flag and pole assembly is positioned in said stowed position.

17. The water safety floatation assembly of claim 16, wherein:

said segment of material is a segment of cloth material, and said segment of cloth material is attached to said rear facing side of said floatation member so as to form a compartment.

* * * * *